US005910759A

United States Patent [19]

Passow

[11] Patent Number: 5,910,759

[45] Date of Patent: Jun. 8, 1999

[54] CONTACT MECHANISM FOR ELECTRONIC OVERLOAD RELAYS

[75] Inventor: Christian Henry Passow, Batavia, Ill.

[73] Assignee: Siemens Energy & Automation, Inc., Alpharetta, Ga.

[21] Appl. No.: 09/079,722

[22] Filed: May 15, 1998

[51] Int. Cl.[6] ..... H01H 51/22

[52] U.S. Cl. ..... 335/78; 335/113; 335/80

[58] Field of Search ..... 335/78–86, 115–117, 335/113, 124, 126–131

[56] References Cited

U.S. PATENT DOCUMENTS

| | | | |
|---|---|---|---|
| 3,925,742 | 12/1975 | Muench | 335/186 |
| 3,993,971 | 11/1976 | Ono et al. | 335/202 |
| 4,181,907 | 1/1980 | Esposito et al. | 335/170 |
| 5,394,127 | 2/1995 | Hendel | 335/78 |

*Primary Examiner*—Lincoln Donovan

[57] ABSTRACT

Ease of assembly, inexpensive construction and improved reliability may be achieved in a trip mechanism for an overload relay including a housing containing a bistable armature mounted in the housing on a pivot for pivotal movement between two stable positions. Fixed contacts are located within the housing and moveable contacts are carried by leaf springs for movement to a closed position with the fixed contacts for one of the two stable positions and for movement to an open position relative to the fixed contacts for the other of the two stable positions. Projections carried by the armature are operative to move the leaf springs and their associated contacts. A latch arm is carried by the armature and has a latch surface. A spring is mounted on the housing and has a latch finger for engaging the latch surface and retaining the armature in one of the two positions.

10 Claims, 1 Drawing Sheet

CONTACT MECHANISM FOR ELECTRONIC OVERLOAD RELAYS

FIELD OF THE INVENTION

This invention relates to electrical relays, and more particularly, to a trip mechanism for an overload relay.

BACKGROUND OF THE INVENTION

Overload relays are electrical switches typically employed in industrial settings to protect electrical equipment from damage due to overheating in turn caused by excessive current flow. In a typical case, the electrical equipment is a three-phase motor which is connected to a power source through another relay commonly referred to as a contactor. A typical contactor is a heavy duty relay having three switched power paths for making and breaking each of the circuits connected to the three phase power source. The motion required to make and break the contacts is provided magnetically as a result of current flow through a coil which in turn is energized by a current whose flow is controlled by another switch, typically remotely located.

In a conventional setup, an overload relay is connected in series with the control switch for the coil of the contactor. When an overload condition is detected by the overload relay, the same cuts off power to the coil of the contactor, allowing the contactor to open and disconnect the electrical equipment that is controlled by the contactor from the source of power to prevent injury to the electrical equipment.

In the past, overload relays have utilized resistive heaters for each phase which are in heat transfer relation with a bimetallic element which in turn controls a switch. When an overload is sensed as, for example, when there is sufficient heat input from the resistive heater to the bimetallic element, the bimetallic element opens its associated switch to de-energize the contactor coil and disconnect the associated piece of electrical equipment from the source of power.

More recently, the resistive heater-bi-metallic element type of relay has been supplanted by electronic overload relays. See, for example, commonly assigned U.S. Pat. No. 5,179,495 issued Jan. 12, 1993, to Zuzuly, the entire disclosure of which is herein incorporated by reference. Outputs of such circuitry typically are relatively low powered and as a consequence, in order for the output to control the contactor coil current, a solid state switch may be required. The solid state switch may, in turn, control flow to a relatively low power contact mechanism which in turn is operable to control the flow of current to the contactor as well as to operate an indicator. In the usual case, the indicator will be a light which will be illuminated upon the occurrence of a disconnect resulting from an overload. One such contact mechanism is disclosed in my commonly assigned copending application entitled, "Trip Mechanism for an Overload Relay", Ser. No. 08/838,904, Filed Apr. 11, 1997, the entire disclosure of which is herein incorporated by reference.

The mechanism therein disclosed works extremely well for its intended purpose. However, because the same uses so-called "bridging" contacts, assembly is somewhat more difficult, increasing its cost. Moreover, bridging contacts may pose reliability problems when a circuit is to be made (as opposed to broken), particularly at low currents or loads that are associated with solid state devices. Specifically, in a bridging contact, two spaced fixed contacts are employed along with a moveable contact bar. The contact bar must make good electrical contact with both of the fixed contacts in order to complete a circuit with the consequence that if either contact is deteriorated as a result of arcing or the like, or if grime enters the switching mechanism, the circuit cannot be made. Because two contacts are involved, the likelihood of failure may be as much as doubled over the situation where only one contact is employed.

The present invention is directed to overcoming one or more of the above problems.

SUMMARY OF THE INVENTION

It is the principal object of the invention to provide a new and improved trip mechanism for an overload relay. More specifically, it is an object of the invention to provide an improved trip mechanism for an overload relay that is easier and more economical to assemble and which has improved reliability.

An exemplary embodiment of the invention achieves the foregoing object in a trip mechanism for an overload relay that includes a housing, a bistable armature mounted in the housing on a pivot for pivotal movement between two stable positions, and fixed contacts within the housing. Moveable contacts carried by leaf springs are provided for movement to a closed position with the fixed contacts for one of the two stable positions and for movement to an open position relative to the fixed contacts for the other of the two stable positions. The leaf springs are positioned to be engaged by the armature. A latch surface is carried by one of the armature and the housing and a spring is mounted on the other of the armature and the housing and has a latch finger for engaging the latch surface and retaining the armature in one of the two positions.

In a preferred embodiment, the leaf springs are spaced from one another and are on opposite sides of the pivot. The armature includes at least two projections, one on each side of the pivot, for engaging a corresponding one of the leaf springs.

In a preferred embodiment, the leaf springs have fixed ends secured to the housing and moveable ends carrying the moveable contacts. The moveable ends are bifurcated to define two contact fingers and there is one of the moveable contacts on each of the fingers.

According to another aspect of the invention, there is provided a trip mechanism for an overload relay which includes a housing, and a bistable armature mounted in the housing on a pivot for pivotal movement between two stable positions. Fixed contacts are located within the housing and a pair of leaf springs are provided, each having one end secured to the housing and an opposite free end. Moveable contacts are carried by the free ends of the leaf springs for movement to a closed position with the fixed contacts for one of the two stable positions and for movement to an open position relative to the fixed contacts for the other of the two stable positions. Actuators are mounted on and moveable with the armature for engaging a corresponding one of the leaf springs and a latch arm is carried by the armature and has a latch surface. A torsion spring is mounted on the housing and has a latch finger for engaging the latch surface and retaining the armature in one of the two positions. A push button is reciprocally mounted in the housing for movement into and out of engagement with the latch finger. The push button when pushed into engagement with the latch finger, dislodges the latch finger from the latch surface to release the latch arm.

Additional objects and advantages of the invention will be set forth in the description which follows and in part will be obvious from the description, or may be learned by practice of the invention. The objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate a presently preferred embodiment of the invention and, together with the general description given above and a detailed description of the preferred embodiment given below, serve to explain the principles of the invention.

DESCRIPTION OF THE PREFERRED EMBODIMENT

Figure 1:
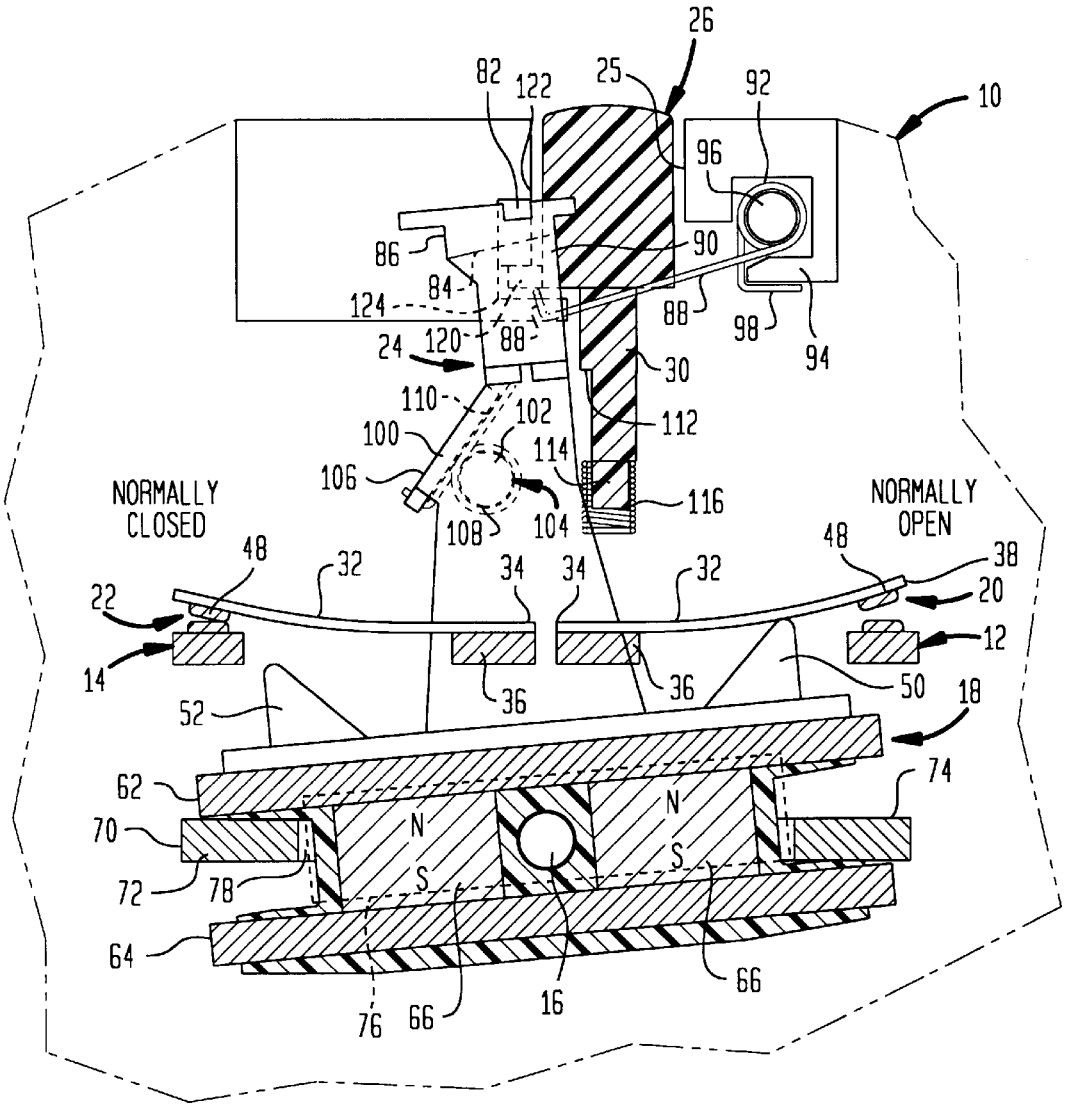
FIG. 1 is a somewhat schematic, sectional view of a trip mechanism made according to the invention showing the configuration of the components in an automatic reset position.

Referring to the drawings, the overload relay as shown in a reset position, specifically, an auto-reset position, and includes a housing, generally designated 10, shown fragmentarily. Mounted within the housing is a first set of normally open, fixed contacts, generally designated 12, and a set of normally closed, fixed contacts, generally designated 14. The housing includes a pivot pin 16 upon which an elongated, bistable armature, generally designated 18 is pivoted. The armature is shown in one of its stable positions and is operative to maintain a first set of moveable contacts, generally designated 20, in an open position. In its other bistable position, the armature 18 is operative to open a second set of moveable contacts, generally designated 22, which are normally closed. The contacts 20 and 22 make and break with the fixed contacts 12 and 14, respectively.

A latch lever, generally designated 24, is connected to the armature to be moveable therewith and thus will rock about the pivot 16 between the two stable positions of the armature 18.

Figure 2:
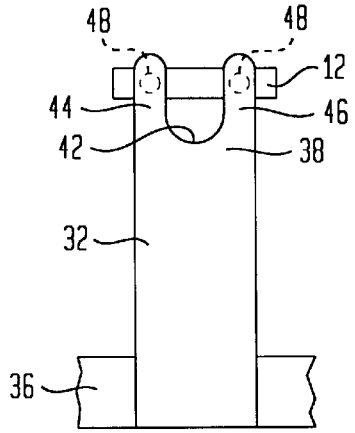
FIG. 2 is a fragmentary plan view of a preferred form of a set of contacts used in the invention.

The housing includes an opening 25 which reciprocally receives a manual operator, generally designated 26, which includes a push button surface 28 and a depending shank 30. The push button 28 is mounted for movement generally toward and away from the latch lever 24. Turning to the moveable contacts 20,22, their constructions are generally identical and each includes an elongated leaf spring 32 having one end 34 mounted to a housing part 36 and a free end 38. The free end, in one embodiment of the invention, and as shown in FIG. 2, is bifurcated as at 42 to define two contact fingers, 44 and 46. Each of the contact fingers carries a contact 48 which closes against the corresponding contact or set of fixed contacts 12,14 as the case may be. In the usual case, normally open contacts 12,20 are operative to provide power to an indicator, such as an electrical light, to illuminate the same when the relay has been tripped. On the other hand, the normally closed contacts 14,22 are normally employed to provide electrical power to the coil of a contactor to energize the same to in turn provide electrical power to the piece of equipment, typically a motor, being controlled. While the leaf spring 32 need not be bifurcated at its free end 38 and thus may mount but a single one of the contacts 48, the bifurcated construction is preferred since only one of the contacts 48 on a given one of the leaf springs 34 need make contact with the associated fixed contact 12,14 to make an electrical circuit. As a consequence, if one of the contacts becomes corroded or is fouled as by environmental grime, the circuit can still be made by the other contact, providing improved reliability.

It will also be appreciated that use of a leaf spring contact construction reduces the number of components that are required in each set of contact 12,20; 14,22 providing for easier assembly and a more economical construction than would be the case if bridging contacts were used.

The armature 18 carries two projections 50,52, one on each side of the pivot 16. The projection 50 is adapted to engage the leaf spring 32 associated with the contacts 12,20 to open the same while the projection 52 is operable to engage the leaf spring 32 engageable with the contacts 14,22 to open them as well.

The armature 18 includes a first magnetic pole piece 62 and a parallel, spaced second pole piece 64. Pole pieces 62 and 64 sandwich the pivot 16 as well as two permanent magnets 66. The two permanent magnets 66 could be combined into a unitary structure if desired but for convenience, to accommodate the pivot, two of the magnets 66 are employed.

The housing mounts a magnetic yoke or pole piece 70 which is in the form of a shallow "U" having legs 72 and 74. A coil 76 is disposed about the bight of the pole piece 70. In some cases, the coil 76 will be defined by a single coil while in other cases, two electrically separate coils will be wound thereon, one on top of the other. The particular arrangement depends upon the control mode of the electronic circuitry employed. If the same reverses current flow through the coil 76 to switch the relay from one state to the other, only a single coil need be used. On the other hand, if the electrical circuit does not reverse current flow, but rather switches it from one coil to the other, then two coils, oppositely wound from one another, will be employed as the coil 76.

Turning now to the latch lever 24, the same is moveable within the housing 10 with the armature 18 between two bi-stable positions as noted previously. One position is that shown in FIG. 1 while another position will have the projection 52 opening the electrical contacts 14,22 and allowing the contacts 12,20 to close.

The latch lever 24, at its upper end, includes an elongated notch 82 which underlies an opening (not shown) in the housing 10. A tool, such as the tip of a screwdriver, can be fitted through the opening and inserted in the notch 82 to apply a manual force to the lever 24 to shift it between the two stable positions for manual test purposes.

Just below the notch 82, a latch surface defined by two adjoining surfaces 84,86 is provided. Underlying the latch surface 84,86 is a spring latching finger 88 having an upturned end 90 which is adapted to embrace and latch against the surface 86 of the latch surface 84,86 under certain conditions to be described. The latch finger 88 extends from the coil 92 of a torsion spring, generally designated 94, which is mounted on a post 96 within a pocket within the housing 10. Alternatively, the spring 94 may be mounted on the latch lever 24 and the latch surface 84,86 on the housing 10.

The end 98 of the coil 92 opposite the latch finger 88 is abutted against the housing 10 to prevent rotation of the coil 92 on the post 96. The latch finger may latch the latch lever in one of the two stable positions of the armature 18, such position being the one not shown in FIG. 1.

The latch lever 24 also carries a flat, diagonal projection 100 closely adjacent to a post 102 which is generally parallel to the pivot 16. A second torsion spring, generally designated 104, is mounted on the post 102 and includes one end 106 fixed to the projection 100 to prevent rotation of the coil 108 of the torsion spring 104 about the post 102. The opposite end 110 of the torsion spring 104 acts as a reset finger and extends diagonally, at an acute angle past the end of the projection 100 in the direction of the push button actuator 26. In this connection, the shank 30 of the push button actuator 26 includes a notch 112 which acts as a stop surface and cooperates with the reset finger 110 for shifting the latch 24 from a tripped position, that is, the position not shown in FIG. 1, to the reset position illustrated in FIG. 1.

Turning now to the push button 26 actuator, and specifically the shank 30, the lower end includes a ledge 114 against which a biasing spring 116 is abutted. The biasing spring 116 provides an upward bias to the push button 26 to bias the same upwardly from the position shown in FIG. 1.

Just above the shank 30, the operator 26 includes an outwardly extending tongue or ledge or 120. At the same time, the housing 10 includes a first notch having a retaining surface 122 and a second notch having a detent surface 124. In its full uppermost position, the ledge 120 of the push button actuator 26 abuts the notch 122 and is retained within the housing 10 thereby.

Preferably, the operator 26 is of generally cylindrical cross section except for the ledge 120 so as to be rotatable within the housing 10 as well as reciprocal therein. As a consequence, when the operator is pushed downwardly to the position illustrated in FIG. 1, the same may be rotated to bring the ledge 120 into underlying relation with the detent surface 124. In this position, the operator is retrained in its lowermost position which corresponds to the automatic reset mode shown in FIG. 1.

It is to be particularly observed that in the automatic reset mode, the ledge 120 abuts the upper end 90 of the latch finger 88. As seen in FIG. 1, this holds the latch finger 88 out of engagement with the latch surface 84,86 on the latch arm 24. However, if the push button 28 is rotated to bring the ledge 120 out of engagement with the detent surface 24 and allowed to move upwardly within the housing 10 as a result of the bias of the spring 116, the upper end 90 of the latch finger 88 will rest against the surface 84. If the relay is tripped, the armature 18 will be caused to move to its other bistable position (the one not shown in FIG. 1) with a consequence that the spring finger 88 will be cammed along the surface 84 to ultimately lodge behind the latch surface 86 and hold the latch lever 24 in its tripped position.

To reset the relay, the push button, assuming its in its uppermost position, is pushed downwardly. When the ledge 120 encounters the upper end 90 of the spring finger 88, the spring finger 88 will be moved out of engagement with the latching surface 86. At the same time, the end 110 of the spring 104 will have lodged in the notch 112 and further downward movement of the push button 26 will cause the end 110 of the spring 104 to move toward the horizontal position, simultaneously driving the latch lever 24 to the position illustrated in FIG. 1.

Other structural and operational features of the mechanism may be ascertained by reference to my previously identified co-pending application.

From the foregoing, it will be appreciated that an overload relay made according to the invention, by reason of the use of the leaf springs 32 carrying the contacts 48 is significantly easier to assemble and more economical. It is also more reliable in that it includes fewer parts than a bridging contact type of mechanism. That reliability may be further enhanced through the use of a bifurcated free end 38 on each of the leaf springs, to define two contact fingers 44,46, each carrying one of the contacts 48.

Additional advantages and modifications will readily occur to those skilled in the art. Therefore, the invention in its broader aspect is not limited to the specific details, and representative devices, shown and described herein. Accordingly, various modifications may be made without departing from the spirit or scope of the general inventive concept as defined by the appended claims and their equivalents.

I claim:

1. A trip mechanism for an overload relay comprising:

a housing;

a bistable armature mounted in said housing on a pivot for pivotal movement between two stable positions;

fixed contacts within said housing;

moveable contacts carried by leaf springs for movement to a closed position with said fixed contacts for one of said two stable positions and for movement to an open position relative to said fixed contacts for the other of said two stable positions, said leaf springs being positioned to be engaged by said armature;

a latch arm carried by one of said armature and said housing and having a latch surface thereon; and a spring mounted on the other of said armature and said housing and having a latch finger for engaging said latch surface and retaining said armature in one of said two positions.

2. The trip mechanism of claim 1 wherein said leaf springs are spaced from one another and on opposite sides of said pivot; and said armature includes at least two projections, one on each side of said pivot for engaging a corresponding one of said leaf springs.

3. The trip mechanism of claim 2 wherein said leaf springs have fixed ends secured to said housing and moveable ends carrying said moveable contacts; said moveable ends are bifurcated to define two contact fingers; and there is one of said moveable contacts on each of said fingers.

4. The trip mechanism of claim 1 wherein said leaf springs have fixed ends secured to said housing and moveable ends carrying said moveable contacts; said moveable ends are bifurcated to define two contact fingers; and there is one of said moveable contacts on each of said fingers.

5. A trip mechanism for an overload relay comprising:

a housing;

a bistable armature mounted in said housing on a pivot for pivotal movement between two stable positions;

fixed contacts within said housing;

a pair of leaf springs each having one end secured to said housing and an opposite free end;

movable contacts carried by said free ends for movement to a closed position with said fixed contacts for one of said two stable positions and for movement to an open position relative to said fixed contacts for the other of said two stable positions;

projections mounted on and moveable with said armature for engaging a corresponding one of said leaf springs;

a latch arm carried by said armature and having a latch surface thereon;

a torsion spring mounted on said housing and having a latch finger for engaging said latch surface and retaining said armature in one of said two positions; and a push button reciprocally mounted in said housing for movement into and out of engagement with said latch finger, said push button, when pushed into engagement with said latch finger dislodging said latch finger from said latch surface to release said latch arm.

6. A trip mechanism for an overload relay comprising:

a housing;

an armature mounted for movement in said housing between two positions;

fixed contacts in said housing;

a pair of leaf springs in spaced relation within said housing and each having a fixed end secured to said housing and a moveable free end;

moveable contacts carried by said free ends for movement toward and away from said fixed contacts;

means on said armature for engaging said leaf springs having a spring at locations spaced from said fixed ends when said armature moves between said positions;

a moveable lever associated with said armature and operable to shift said armature from at least one of said two positions to the other of said two positions;

an operator for said lever including an element moveable toward and away from said lever;

a spring finger carried by one of said lever and said operator and extending at an acute angle therefrom toward the other of said lever and said operator; and a stop surface on the other of said lever and said operator positioned to be engaged by said spring finger when said armature is in said one position and said operator is moved toward said lever and to disengage and release said spring finger when said armature has moved to the other of said two positions.

7. The trip mechanism of claim 6 wherein said spring is a torsion spring having a coil mounted on a post and said spring finger extends from said coil.

8. The trip mechanism of claim 7 wherein said post is on said lever and said stop surface is on said operator.

9. The trip mechanism of claim 8 wherein said operator is a manual operator.

10. The trip mechanism of claim 6 wherein said free ends are bifurcated to define two contact mounting fingers; one of said moveable contacts being disposed on each of said contact mounting fingers; said fixed contact being in pairs with the fixed contacts of each pair being positioned to be engaged by respective ones of the moveable contacts on respective bifurcated free ends of respective leaf springs.

* * * * *